United States Patent [19]

Venable

[11] Patent Number: 4,996,812

[45] Date of Patent: Mar. 5, 1991

[54] METHOD OF MEMBRANE APPLICATION IN ROOF CONSTRUCTION

[75] Inventor: Jesse S. Venable, Rte. 1, Herington, Kans. 67449

[73] Assignee: Jesse S. Venable, Herington, Kans.

[21] Appl. No.: 483,163

[22] Filed: Feb. 20, 1990

[51] Int. Cl.[5] ..... E04B 5/00; D06N 7/04

[52] U.S. Cl. ..... 52/408; 52/309.7; 52/363; 52/741; 52/747; 428/148; 428/198; 428/451; 428/913

[58] Field of Search ..... 52/408–410, 52/309.7, 309.9, 309.11, 361–363, 344, 445, 741, 747, 746; 428/148–150, 331, 337, 451, 913, 198

[56] References Cited

U.S. PATENT DOCUMENTS

| | | | |
|---|---|---|---|
| 1,152,860 | 9/1915 | Stoetzer | 52/445 X |
| 4,078,348 | 3/1978 | Rothman | 52/309.7 |
| 4,693,923 | 9/1987 | McGroarty et al. | 52/408 X |
| 4,747,247 | 5/1988 | Petersen et al. | 52/408 |
| 4,841,705 | 6/1989 | Fuhrer | 52/410 |
| 4,882,888 | 11/1989 | Moore | 52/408 X |

FOREIGN PATENT DOCUMENTS

| | | | |
|---|---|---|---|
| 2208419 | 6/1974 | France | 52/445 |

*Primary Examiner*—Richard E. Chilcot, Jr.

*Attorney, Agent, or Firm*—Hovey, Williams, Timmons & Collins

[57] ABSTRACT

A composite roof structure, and a corresponding method of fabricating the structure, are disclosed which includes use of a layer of adhesive material (preferably a foamed, cellular adhesive such as polyurethane) along with a flexible membrane including a rubber-like sheet having a fleece-like matting secured to the underside thereof. The adhesive is preferably sprayed onto a roof substrate and prior to complete solidification thereof the membrane is pressed into the adhesive so that the matting becomes embedded therein.

26 Claims, 1 Drawing Sheet

METHOD OF MEMBRANE APPLICATION IN ROOF CONSTRUCTION

BACKGROUND OF THE INVENTION

1. Field of the Invention

The present invention is broadly concerned with a composite roof structure, and a method of forming the same, wherein use is made of an adhesive adapted to be secured to a roof substrate, along with an upper, flexible membrane comprising a sheet of flexible rubber-like material with fleece-like matting secured to the underside thereof. In practice, a relatively slow-setting polyurethane foam adhesive is employed, with an EPDM rubber membrane having a polyester matting secured thereto. In application procedures, the adhesive is sprayed onto a properly prepared roof substrate and, prior to complete solidification of the adhesive, the flexible membrane is applied so that the matting becomes at least partially embedded within the adhesive. Upon complete adhesive solidification, the membrane is secured in place, with a vapor venting spacing being provided between the adhesive material and rubber-like sheet.

2. Description of the Prior Art

Many different roofing systems have been proposed in the past, ranging from simple asphalt/gravel roofs to more sophisticated structures making use of synthetic resin materials such as polyurethanes. Roofs fabricated using foamed materials have presented problems because of the fact that the foams tend to set up and solidify almost immediately, thereby making it difficult to properly bond membranes or other materials thereto.

It has also been known in the past to construct roofs using synthetic rubber membranes formed from EPDM rubber. In such constructions, asphalt or other adhesive substance is first applied to a substrate, followed by an attempt to directly adhere the EPDM rubber to the adhesive. In the first place, it is very difficult to properly bond the EPDM rubber directly with an adhesive, and accordingly the resultant roof is subject to wind uplifts. Secondly, such a construction provides little if any vapor ventilation capabilities, and thus such roofs are often prone to excessive blistering.

SUMMARY OF THE INVENTION

The present invention overcomes the problems outlined above and provides a greatly improved composite roof broadly including a layer of adhesive material adapted to be secured to a substrate, along with a flexible membrane attached to the adhesive. The membrane includes a sheet of flexible material (e.g. EPDM rubber) having a fleece-like matting secured to the underside thereof. It has been found that the use of such matting permits the membrane to be strongly adhered to the adhesive, with the matting being at least partially embedded within the adhesive itself. At the same time, use of the matting makes it possible to fabricate the roof structure with a vapor venting spacing between the adhesive material and flexible membrane sheet.

In particularly preferred forms, the adhesive material is in the form of a layer of foamed, cellular synthetic resin material, most preferably polyurethane foam. The adhesive layer has a thickness after solidification of at least about 150 inch, and more preferably from about 150 -½inches. Furthermore, in order to facilitate installation, the adhesive material is initially in the form of a liquid and has an initial solidification time in excess of about 30 seconds, and more preferably from about 30 seconds-5 minutes. Advantageously, the polyurethane adhesive is a two-component system having polyol/-diisocyanate components.

The flexible membrane preferably comprises a synthetic rubber (EPDM) sheet having a thickness of from about 40–70 mils, with fleece-like non-woven polyester matting having a thickness from about 40–80 mils secured thereto. This membrane is manufactured by the Colonial Rubber Company of Dyersburg, Tenn. and is supplied in rolls. While such an EPDM/polyester membrane is preferred, the invention is not so limited; rather, use can be made of a wide variety of thermoplastic or thermosetting elastomeric flexible materials having a selected textile matting (e.g. polyolefinic) secured to the underside thereof.

DESCRIPTION OF THE PREFERRED EMBODIMENTS

Figure 1:
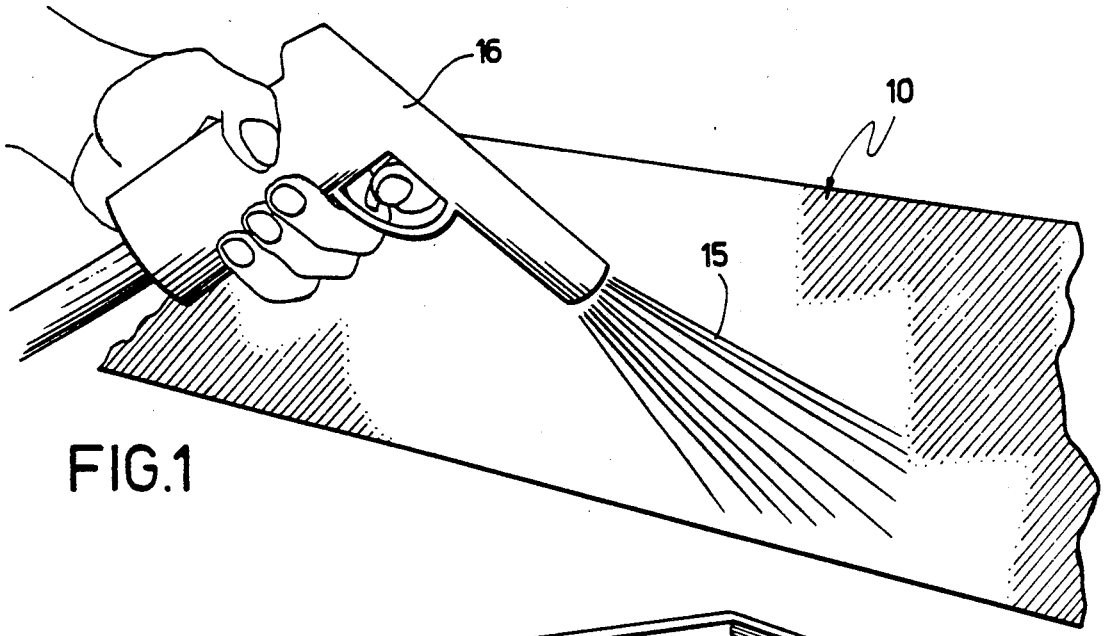
FIG. 1 is a schematic view illustrating the application of a preferred adhesive to a roof substrate in the fabrication of the composite roof in accordance with the invention.

Turning now to the drawing, the preferred procedure for fabrication of a composite roof in accordance with the invention is illustrated. Generally speaking, the roofs hereof are applied to an otherwise conventional roof substrate 10 which may include metal decking 12 and a layer of insulated foam 14. In preparing the substrate, the upper surface thereof should be clean and free of grease, and any sharp edges should be repaired. Although a metal/insulated foam substrate has been illustrated, it will be appreciated that the invention is not so limited. Thus, the composite roof can be directly applied to plywood, chipboard, concrete, or smooth-surfaced or gravel-surfaced built up roofs. If insulation is installed, however, it should be compatible with the adhesive system employed.

If the substrate is in the form of a ferrous metallic deck, such should be primed with an appropriate metallic primer; if a non-ferrous deck forms the substrate, it should be treated with a wash primer. Substrates of chromate-treated galvanized material should be brush blasted in accordance with SSPC-SP7-63T or acid etched and neutralized before priming. Concrete and/or masonry roof substrates should have a minimum cure of 28 days at 70 degrees F and 50% relative humidity. All such surfaces should be clean, dry, free of all dust, dirt, grease and oil prior to priming. Where necessary, concrete and/or masonry surfaces should be brush blasted to the texture of medium grade sandpaper or acid etched with a 10% muratic acid solution and neutralized prior to priming. Where necessary, the concrete and/or masonry surfaces should be primed with conventional masonry primer. In the case of existing built up gravel roofs, the roofs should be power broomed in separate perpendicular passes to remove all loose gravel and, where necessary, power vacuumed. All blistered and delaminated or damaged areas should be removed and insulated foam applied until flush and smooth with the surrounding roof. All loose felts and flashings should be mechanically fastened and/or removed.

After the substrate is prepared, the adhesive 15 is applied. Referring to FIG. 1, it will be seen that use is made of a conventional spray gun apparatus 16 for this purpose. Where the preferred two-component polyurethane adhesive is used, the polyol and diisocyanate components are mixed within the body of the gun and sprayed onto the substrate 10 as illustrated. The adhesive is applied so as to obtain a final thickness, after complete solidification thereof, of from about 150 -½inch. Generally speaking, this corresponds to an application rate of 1 pound of adhesive per 8 to 12 square feet of substrate surface.

Immediately after application of the adhesive, the membrane 18 is placed in contact with the adhesive. It is important that the membrane be applied prior to complete set up and solidification of the adhesive 15. Where the membrane is supplied in roll form, it can simply be unrolled behind the spray applicator. As explained, the membrane 18 includes an upper flexible EPDM rubber layer 20 together with a non-woven polyester fleece-like layer 22 secured to the underside of the rubber layer. After the membrane 18 is unrolled and positioned on the substrate, it is gently pressed into the adhesive layer by means of a soft 18-inch roller similar to a paint roller. Preferably, rolling is done in a single pass at a 45 degree angle relative to the longitudinal axis of the unrolled membrane. After initial set of the adhesive (approximately 5–10 minutes) butt joints are rolled with a seam roller. At parapets the membrane is turned up the parapet wall and fully adhered to using the adhesive. At roof penetrations, the membrane is cut as close as possible to the base of the penetration (in the case of pipes) or "X"cut to allow membrane to turn up onto base flashings.

Figure 2:
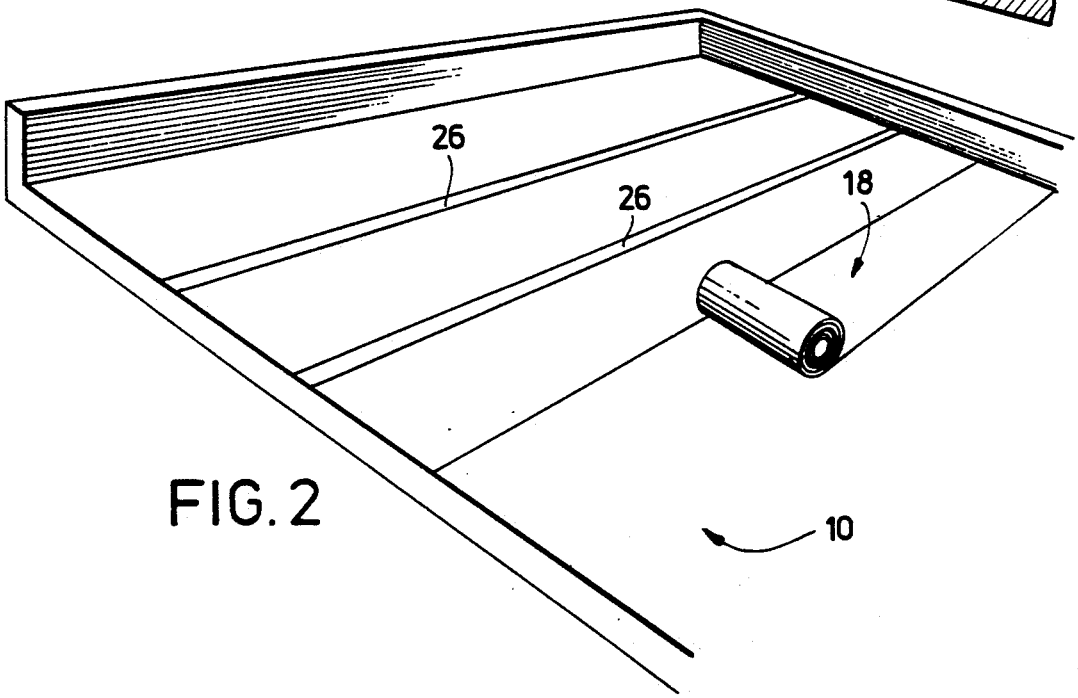
FIG. 2 is a perspective view of the application of flexible membrane over the adhesive layer.
Figure 3:
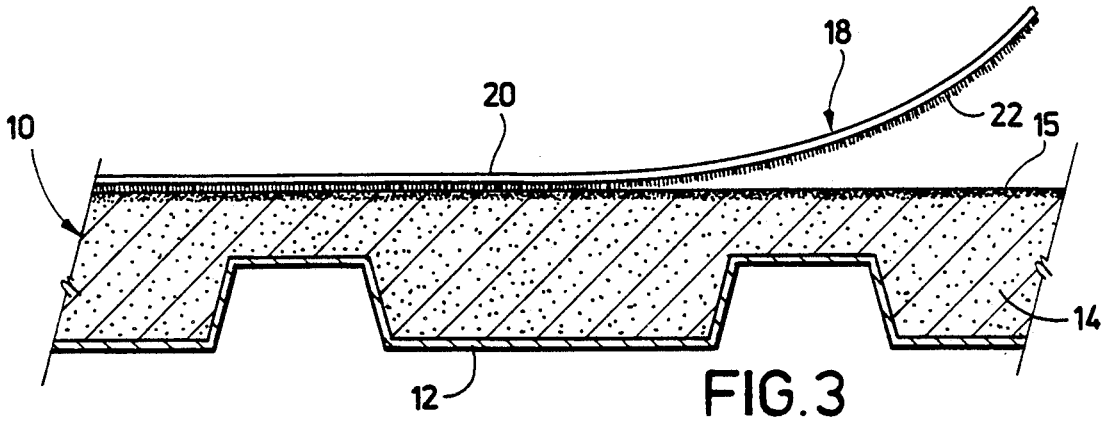
FIG. 3 is an enlarged vertical sectional view illustrating the construction of the composite roof.

As illustrated in FIG. 2, the membrane 18 is applied in side by side strips and thus presents, between respective strips, seam areas 24. In order to complete the roof structure, uses made of relatively narrow (e.g., 6 inch) seaming material 26 in the form of extruded black rubber tape which is factory laminated to a cured EPDM rubber membrane. The tape is soft and tacky and is covered with a release liner. The seaming material is applied to clean, dry membrane sheets which are aligned with butted edges as illustrated in FIG. 2. The seaming material is then centered over the butt joint, making sure there are no bridging areas or wrinkles. The release paper is then stripped from the tape, and light hand pressure is applied to assure adherence to the underlying membranes. The seam is then rolled with a small steel roller (3–4 inches wide) with about 5 pounds per linear inch pressure, 3 passes minimum.

Finally, the edges of the applied seaming material 26 are sealed with a lap sealant in the form of a high grade roof membrane caulk. Finishing details around guttering, snap-on edges or the like are then completed, using conventional techniques.

As explained above, the preferred adhesive 15 is a polyurethane foam system designed for bonding the described membrane to acceptable substrates. The diisocyanate and polyol components are mixed in gun 16 in an approximately 1:1 volumetric ratio. The final adhesive, when solidified, has a free-rise core density of at least about 2.0 pounds per cubic foot, and more preferably 2.5 pounds per cubic foot and above. The polyol component consists primarily of a conventional polyol along with surfactants and catalytic agents. One preferred polyol component includes 86.4% by weight StepanPol PB-9513 (polyol), 0.8% by weight silicone DC197 (surfactant),0.25% by weight Dabco 33LV, 0.50% by weight Polycat 8 (catalyst), 0.5% by weight diethanolamine, 8.2% by weight Pelron 9338, and 3.35% by weight water. The diisocyanate component is completely conventional. The aforementioned two adhesive components are obtained from Stepan Chemical Co. of Chicago, Il.

While a two component polyurethane system can be used to good effect, the invention is not so limited. Thus, use can also be made of a single component polyurethane adhesive if desired.

The membrane 18 desirably has the following physical properties, in addition to those described previously.

TABLE

| PHYSICAL PROPERTIES | TEST METHOD | TEST VALUE* | TYPICAL VALUE |
|---|---|---|---|
| Breaking Strength, minimum lb. force/in. | D751 | 50 | 60 |
| Elongation @ Backing Break, minimum % | D751 | 50 | 80 |
| Elongation @ Membrane Break, minimum % | D751 | 250 | 350 |
| Elongation, Ultimate, minimum % | D412 | 300 | 400 |
| Tearing Resistance, minimum lb. force/in. | D412, Die C* | 150 | 200 |
| Tongue Tear Strength | D751 | 25 | 35 |
| Brittleness Point, maximum | D2137 | −49 degrees F. | −75 degrees F. |
| Linear Dimensional Change, maximum % | D1204 | ±2 | 1 |
| Ozone Resistance | D1149 | No Cracks | No Cracks |
| Heat Aging (28 days at 115 degrees C. [240 degrees F.]) | D573 | | |
| Breaking Strength, minimum lb. force/in. | | 40 | 45 |
| Elongation, Ultimate, minimum % | | 200 | 250 |
| Tear Resistance, minimum lb. force/in. | D412, Die C* | 125 | 175 |
| Tongue Tear Strength, min. lb. force | D751 | 20 | 25 |
| Linear Dimensional Change, max. % | D1204 | ±2 | 1 |
| Factory Seam Strength | D816 | Sheet Failure | OK |
| Water Absorption | D471* | +8/−2 | +1 |

*tested without polyester backing

A completed roof structure in accordance with the invention provides many advantages heretofore unachievable. First, the overall cost of the roof is substantially less than prior roofs of this type. The cost reduction stems from the fact that the amount of labor required is drastically reduced, as compared with other roofing systems. With the present invention, it is possible to apply 3 to 5,000 square feet of roofing per hour, which is many times the rate of conventional systems. Accordingly, overall costs are reduced, even though the EDPM rubber/polyester matting membrane is itself more expensive than presently used membranes. Furthermore, the foamed, cellular adhesive was good "breathing" properties, and this, combined with the vapor venting spacing provided between the adhesive and EPDM rubber, provides excellent venting of vapors. As a consequence, blistering is all but eliminated in the roofs of the present invention. The use of a synthetic rubber membrane of the type described give excellent resistance to puncture and long roof life. Finally, the adhesive bond established between the foamed adhesive and polyester matting is extremely strong, to the point that the adherence of the membrane can and often does exceed the wind uplift capabilities of the substrate.

I claim:

1. A composite roof structure adapted to be supported by a roof substrate and comprising:
   a layer of cellular synthetic resin adhesive material adapted to be secured to said substrate; and
   a flexible membrane including a sheet of flexible material having fleece-like matting secured to the underside thereof,
   said membrane being attached to said adhesive material with at least a portion of said matting being imbedded within the adhesive material.

2. The roof structure of claim 1, said adhesive material comprising a layer of foamed, cellular synthetic resin material.

3. The roof structure of claim 2, said adhesive material comprising a layer of polyurethane foam material.

4. The roof structure of claim 2, said layer having a thickness of at least about ⅛inche.

5. The roof structure of claim 4, said thickness being from about ⅛–½inches.

6. The roof structure of claim 1, said adhesive material being initially in the form of a liquid and having a solidification time of from about 30 seconds to 5 minutes.

7. The roof structure of claim 1, there being a vapor venting spacing between said adhesive material and said sheet of flexible material for permitting venting of vapors from said roof structure.

8. The roof structure of claim 1, said sheet of flexible material comprising a synthetic rubber.

9. The roof structure of claim 1, said synthetic rubber being ethylene propylene diene monomer rubber.

10. The roof structure of claim 8, said synthetic rubber sheet having a thickness of from about 40–70 mils.

11. The roof structure of claim 1, said fleece-like matting comprising polyester matting.

12. The roof structure of claim 11, said polyester matting having a thickness of from about 40–80 mils.

13. The roof structure of claim 1, said adhesive comprising a two-component polyurethane adhesive including a polyol and an isocyanate component.

14. A method of forming a composite roof upon a substrate, comprising the steps of:
   providing an initially flowable adhesive material which upon solidification thereof presents a cellular matrix;
   applying said initially flowable adhesive material onto said substrate; and
   prior to complete solidification of said adhesive material, applying a flexible membrane thereto and allowing the adhesive material to solidify,
   said flexible membrane including a flexible sheet having a fleece-like matting secured to the underside thereof,
   said membrane-applying step including the steps of placing said matting in contact with said adhesive material prior to complete solidification thereof, causing said matting to become at least partially embedded within the adhesive material, and thereafter allowing the adhesive material to solidify.

15. A method as set forth in claim 14, said adhesive material comprising a layer of foamed, cellular synthetic resin material.

16. A method as set forth in claim 15, said adhesive material comprising a layer of polyurethane foam material.

17. A method as set forth in claim 15, said layer having a thickness of at least about ⅛inch.

18. A method as set forth in claim 17, said thickness being from about ⅛–½inches.

19. A method as set forth in claim 14, said adhesive material being initially in the form of a liquid and having a solidifcation time of from about 30 seconds to 5 minutes.

20. A method as set forth in claim 14, there being a vapor venting spacing between said adhesive material and said sheet of flexible material for permitting venting of vapors from said roof structure.

21. A method as set forth in claim 14, said sheet of flexible material comprising a synthetic rubber.

22. A method as set forth in claim 21, said synthetic rubber being ethylene propylene diene monomer rubber.

23. A method as set forth in claim 21, said synthetic rubber sheet having a thickness of from about 40–70 mils.

24. A method as set forth in claim 14, said fleece-like matting comprising polyester matting.

25. A method as set forth in claim 24, said polyester matting having a thickness of from about 40–80 mils.

26. A method as set forth in claim 14, said adhesive comprising a two-component polyurethane adhesive including a polyol and an isocyanate component.

* * * * *

US004996812B1

REEXAMINATION CERTIFICATE (3915th)

United States Patent [19]

Venable

[11] B1 4,996,812

[45] Certificate Issued Nov. 2, 1999

[54] METHOD OF MEMBRANE APPLICATION IN ROOF CONSTRUCTION

[75] Inventor: Jesse S. Venable, Herington, Kans.

[73] Assignee: Carlisle Corporation, Syracuse, N.Y.

Reexamination Request:
No. 90/004,969, Apr. 17, 1998

Reexamination Certificate for:

| | |
|---|---|
| Patent No.: | **4,996,812** |
| Issued: | **Mar. 5, 1991** |
| Appl. No.: | **07/483,163** |
| Filed: | **Feb. 20, 1990** |

[51] Int. Cl.[6] ..... E04B 5/00; D06N 7/04

[52] U.S. Cl. ..... 52/408; 52/309.7; 52/363; 52/741.4; 52/745.06; 52/746.11; 428/148; 428/198; 428/451; 428/913

[58] Field of Search ..... 52/408, 309.7, 52/363, 309.9, 309.11, 361, 362, 344, 445, 741.4, 746.1, 746.11, DIG. 16; 428/148–150, 331, 451, 913, 198

[56] References Cited

U.S. PATENT DOCUMENTS 4,087,296 5/1978 Hooker .
4,248,926 2/1981 Tajima et al. .

FOREIGN PATENT DOCUMENTS 3042943 7/1982 Germany .
82/01684 5/1982 WIPO .

OTHER PUBLICATIONS

Michael Russo, "Poly–Back EPDM: Some like it hot," RSI [Roofing|Siding|Insulation] Magazine, Aug. 1989, pp. 32–34, an Edgell Publication, published in U.S.A.

*Primary Examiner*—Christopher Todd Kent

[57] ABSTRACT

A composite roof structure, and a corresponding method of fabricating the structure, are disclosed which includes use of a layer of adhesive material (preferably a foamed, cellular adhesive such as polyurethane) along with a flexible membrane including a rubber-like sheet having a fleece-like matting secured to the underside thereof. The adhesive if preferably sprayed onto a roof substrate and prior to complete solidification thereof the membrane is pressed into the adhesive so that the matting becomes embedded therein.

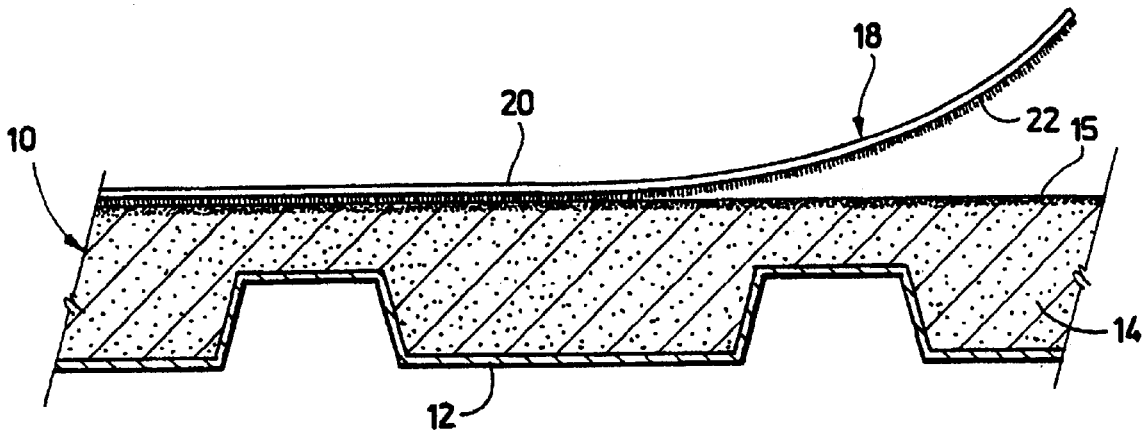

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–26 is confirmed.

* * * * *